US005407298A

United States Patent [19]

Sicking et al.

[11] Patent Number: 5,407,298

[45] Date of Patent: Apr. 18, 1995

[54] SLOTTED RAIL TERMINAL

[75] Inventors: Dean I. Sicking, Lincoln, Nebr.; Roger P. Bligh, Bryan, Tex.; King K. Mak, San Antonio, Tex.; Hayes E. Ross, Jr., Bryan, Tex.

[73] Assignee: The Texas A&M University System, College Station, Tex.

[21] Appl. No.: 78,020

[22] Filed: Jun. 15, 1993

[51] Int. Cl.[6] ..... E01F 15/00

[52] U.S. Cl. ..... 404/6; 256/13.1

[58] Field of Search ..... 256/13.1; 404/6, 7, 404/8, 9, 10

[56] References Cited

U.S. PATENT DOCUMENTS

| | | | |
|---|---|---|---|
| 3,643,924 | 2/1972 | Fitch | 256/13.1 |
| 3,674,115 | 7/1972 | Young et al. | 188/1 B |
| 3,845,936 | 11/1974 | Boedecker, Jr. et al. | 256/1 |
| 3,944,187 | 3/1976 | Walker | 256/13.1 |
| 3,982,734 | 9/1976 | Walker | 256/13.1 |
| 4,066,244 | 1/1978 | Yoho | 256/1 |
| 4,198,036 | 4/1980 | O'Neal | 267/140 |
| 4,307,973 | 12/1981 | Glaesener | 404/6 |
| 4,348,133 | 9/1982 | Trent et al. | 404/6 |
| 4,407,484 | 10/1983 | Meinzer | 256/13.1 |
| 4,583,716 | 4/1986 | Stephens et al. | 256/13.1 |
| 4,605,336 | 8/1986 | Slaw, Sr. | 404/6 |
| 4,607,824 | 8/1986 | Krage et al. | 256/13.1 |
| 4,655,434 | 4/1987 | Bronstad | 256/13.1 |
| 4,661,010 | 4/1987 | Almer et al. | 404/6 |
| 4,815,565 | 3/1989 | Sicking et al. | 188/32 |
| 4,928,928 | 5/1990 | Buth et al. | 256/13.1 |
| 4,971,475 | 11/1990 | Castonguay et al. | 404/7 |
| 5,007,763 | 4/1991 | Burgett | 404/6 |
| 5,112,028 | 5/1992 | Laturner | 256/13.1 |
| 5,286,137 | 2/1994 | Cicinnati et al. | 404/6 |

OTHER PUBLICATIONS

Michie, Jarvis D. "Recommended Procedures for the Safety Performance Evaluation of Highway Appurtenances," National Cooperative Highway Research Program Report 230, Southwest Research Institute, Mar. 1981.

Sicking, Dean L. et al., "Development of New Guardrail End Treatments," Research Report 404-1F, Texas Transportation Institute, Oct. 1988.

Ivey, Don L. et al., "Portable Concrete Median Barriers: Structural Design and Dynamic Performance," Transportation Research Record 769, Transportation Research Board, 1980, pp. 20-30.

*Primary Examiner*—Ramon S. Britts
*Assistant Examiner*—James A. Lisehora
*Attorney, Agent, or Firm*—Conley, Rose & Tayon

[57] ABSTRACT

A slotted rail terminal for highway guardrails. The rail of the terminal contains at least one slotted section extending along the rail and having at least one longitudinal slot of a size sufficient to reduce the ability of the rail to resist bending in response to a loading from one end or the side of the rail. A slot guard is provided which is adapted to be attached to the rail on the side facing away from the highway and downstream of each slotted section relative to expected longitudinal loadings on the rail. The slot guard is configured to abut the rail and span its respective slotted section so as to resist enlargement of each slot. The slot guard enables the slotted section to resist and oppose lateral impacting forces such that the slotted section of the guardrail will act to substantially redirect laterally impacting vehicles.

19 Claims, 3 Drawing Sheets

FIG.3
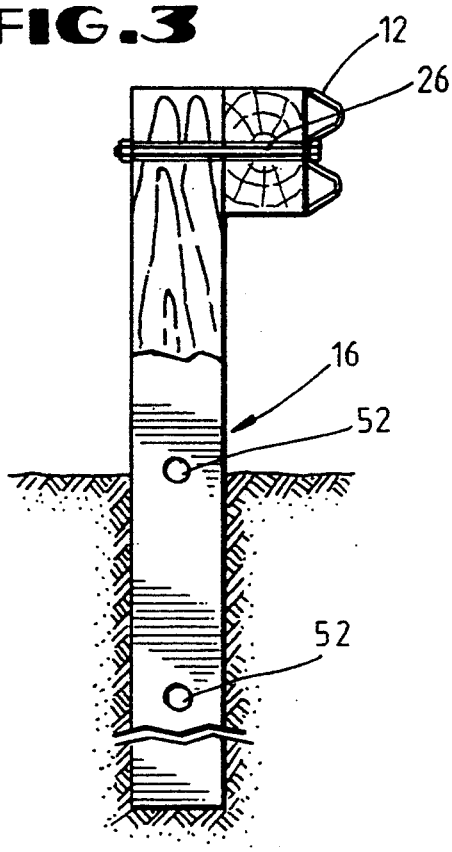
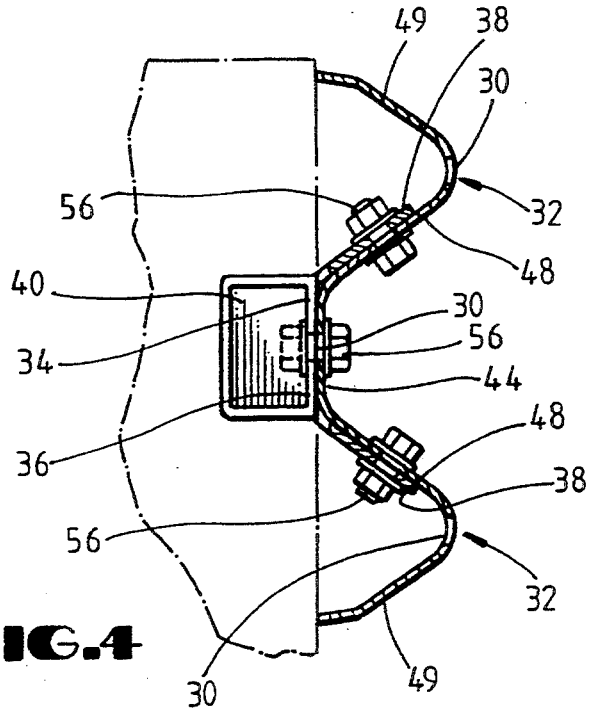
FIG.4
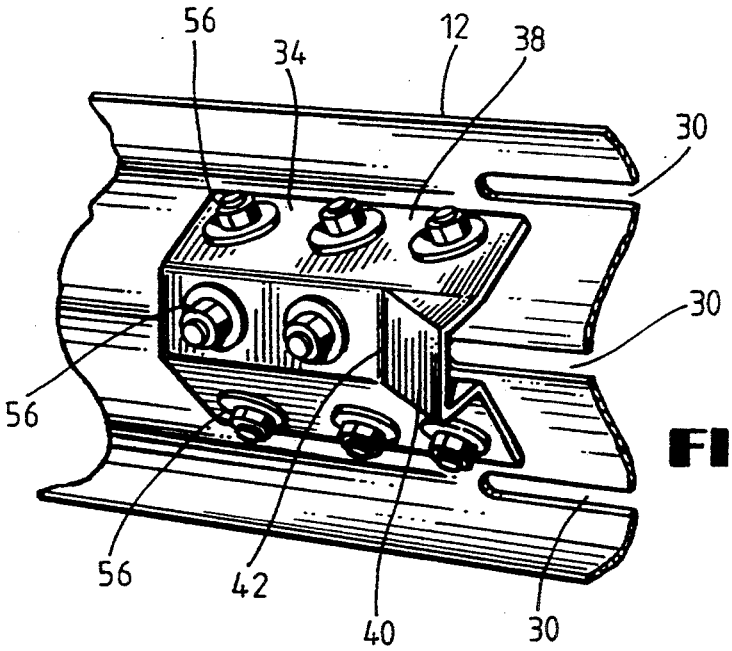
FIG.5

FIG. 6
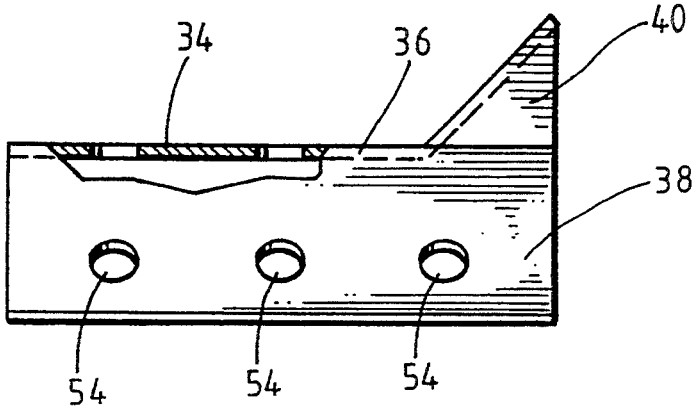
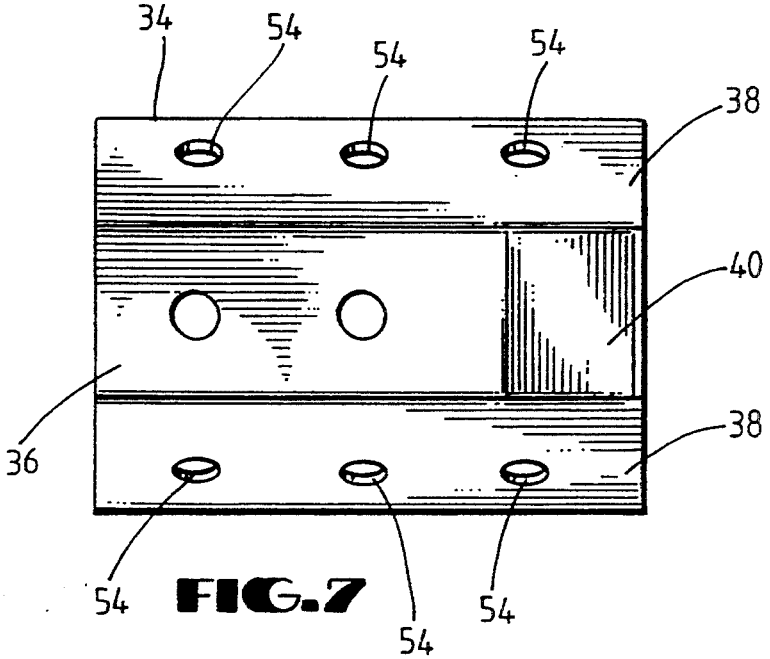
FIG. 7
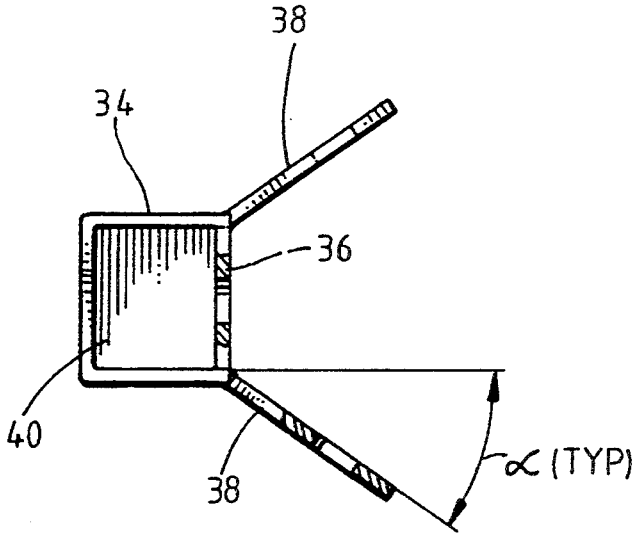
FIG. 8

SLOTTED RAIL TERMINAL

BACKGROUND OF THE INVENTION

1. Field of the Invention

The present invention relates generally to highway guardrail systems and road barriers. More particularly, the invention relates to an improved end treatment for guardrail systems.

2. Description of the Related Art

Along most highways there are hazards that can be a substantial danger to drivers of automobiles if the automobiles were to leave the highway. To lessen the danger guardrails are provided. Semi-rigid W-beam guardrails are usually positioned alongside vehicular traffic routes, especially highways, for the purposes of preventing vehicles from colliding with fixed objects, other vehicles, or driving off the roadway. To this end, the guardrails should have sufficient integrity to prevent an impacting vehicle approaching from an angle relatively oblique to the length of the rail from breaking or tearing through their structure and leaving the roadway. Thus, a guardrail is provided to aid in redirecting an obliquely impacting vehicle back onto the roadway while at the same time dissipating its impact force in a controlled manner.

Guardrails must be installed, however, such that the upstream end, or terminal end of the guardrail facing the flow of traffic is not, itself, a hazard. Early guardrails had no proper termination at the ends, and it was not uncommon for impacting vehicles to become impaled on the raised end of such a guardrail causing intense deceleration of the vehicle and severe injury to the occupants. In some reported cases, the upstream end of guardrail penetrated directly into the occupant compartment of the vehicle fatally injuring the occupants.

Upon recognition of the problem of proper guardrail termination, guardrail designs have been developed employing box beams and W-beams that allow sloping of the end of a guardrail into the ground. These designs provide a ramp and help to eliminate spearing effects. However, while these end treatments have successfully reduced the danger of a vehicle being penetrated in a head-on collision, it has been discovered that they also tend to induce launching of the vehicle to the extent of becoming airborne for a considerable distance with the possibility of rollover.

A number of alternate designs have focused on reducing the dynamic buckling resistance of a raised end-type guardrail against substantially end-on impacts to reduce potential damage to impacting vehicles and injury severity to their occupants. While these end treatments help to reduce dangerous vaulting and roll over of vehicles, they do not provide a panacea.

Designs are also known in which sections of guardrail are curved away from the roadway to create an eccentric loading upon the sections during an end-on impact. The end piece of this design typically includes a customized nose piece which may consist of a fabricated structural steel lever nose surrounded by a vertical section of corrugated steel pipe. The lever nose is adapted to induce a moment near the upstream end of the guardrail sections upon an end-on impact, thereby facilitating desired buckling in the guardrail sections. These designs are also intended to facilitate "gating" of an impacting vehicle through the guardrail structure from the roadway side of the guardrail to the opposite side of the rail. However, they have proven costly.

They are also rather complicated and in actual field installation require careful attention to installation details.

Another safety treatment consists of overlapped guardrail sections that have a series of closely spaced slots. The guardrail segments are attached by bolts extending through the slots. When a vehicle impacts the end of this barrier, the bolts are forced to tear through the guardrail sections from one slot to the next. As a result, the guardrail segments are cut into several long ribbons as an impacting vehicle is decelerated. This safety treatment appears too costly for wide spread implementation as a guardrail end treatment.

A further alternate end treatment is constructed from a series of break away steel guardrail posts and fragile plastic containers containing sandbags. Impacting vehicles are decelerated as the guardrail posts are broken and sand bags in the plastic containers are impacted. A cable is used to guide vehicles away from the guardrail during impact. This type system is very expensive, and has not gained wide acceptance.

A recent development is a terminal in which longitudinal slots are cut into a section of a W-beam rail to reduce the rail's dynamic buckling strength during end-on impacts. The terminal is typically installed on a parabolic flare, or outwardly curving configuration, away from the roadway. Cover plates are used to shield the slots and prevent extension of the slots and tearing of the rail during oblique impacts. The cover plates are sections of W-beam guardrail placed directly over the slots and are bolted to at least one end of the slotted section of guardrail.

The design normally includes a groundline cable to facilitate fracture of support posts and help prevent bending and rotation of the posts prior to breaking. The groundline cable is anchored near ground level to the support post at the most downstream end of the terminal, and extends upstream through boreholes in intermediate posts and is then anchored to the most upstream post. During an end-on collision, the groundline cable prevents rotation of the posts while the bore in each post sufficiently weakens the posts allowing them to break off upon engagement with the impacting vehicle. Additional posts have been used with this design to aid in redirection of obliquely impacting vehicles.

Although this last design meets current safety test criteria, construction details such as the cover plates, groundline cable and additional posts complicate installation and maintenance and have hindered its acceptance in the highway community. The cover plates reduce the ability of the guardrail to buckle and collapse, thereby lessening the rate of energy attenuation. The presence of unreinforced slots to reduce the rail's dynamic buckling resistance to end-on impacts may also function to reduce the rail's integrity during oblique impacts. Heavy or fast obliquely impacting vehicles might actually tear through the rail rather than being redirected back into traffic by it.

It is desirable to provide a guardrail design, having particular application as an end treatment, which addresses the problem of end-on impacts while providing sufficient integrity for the guardrail structure to reduce the problems associated with laterally impacting vehicles tending to tear through the structure. It would further be desirable to provide a guardrail design which assists in redirecting laterally impacting vehicles back toward the roadway.

SUMMARY OF THE INVENTION

The present invention is directed at reducing or overcoming the problems set forth above. The invention is also directed at a system which provides a relatively inexpensive means for retrofitting existing guardrail end terminals.

The present invention features a slotted rail terminal for use with highway guardrail systems. The rail terminal comprises a longitudinally corrugated rail, such as a W-beam rail, with at least one slotted section extending along the rail. The slotted section comprises at least one longitudinal slot in the rail of a size sufficient to reduce the ability of the rail to resist buckling in response to an axial type of loading from end-on impacts. The invention also features a slot guard adapted to be attached to the rail on the side facing away from the highway and downstream of each slotted section relative to expected longitudinal loadings on the rail. The slot guard is configured to abut the rail and span its respective slotted section so as to resist enlargement of each slot upon oblique impacts.

The slot guard preferably comprises a central portion, opposed wing portions and a deflector attached to the upstream end of the central portion and extending at an angle away from the highway. The opposed wing portions and deflector of the slot guard are adapted to resist and oppose lateral impacting forces such that the slotted section of the guardrail will act to substantially redirect obliquely colliding vehicles. The slot guard is preferably placed such that at least one of the slot guards overlap a downstream portion of its respective slotted section.

The slotted rail terminal is typically supported by one or more posts wherein at least one of the posts is preferably a breakaway post. The terminal may be supplemented with a breakaway cable assembly or other safety apparatuses. In operation, the rail terminal may be oriented either parallel to or at an offset with respect to the roadway.

BRIEF DESCRIPTION OF THE DRAWINGS

The foregoing and other advantages of the invention will become more apparent upon reading the following detailed description and upon reference to the drawings in which:

FIG. 3 is an end view of an exemplary support post.

FIG. 4 is a cross-sectional view of an exemplary slot guard of the present invention coupled to a slotted W-beam type rail.

FIG. 5 is a perspective view of the slot guard and rail of FIG. 4.

FIG. 6 is a side view of an exemplary slot guard.

FIG. 7 is a top view of the slot guard of FIG. 6.

FIG. 8 is a cross-sectional view of the slot guard of FIG. 6.

DETAILED DESCRIPTION OF THE PREFERRED EMBODIMENTS

The slotted rail terminal of the present invention incorporates the use of slots to increase the ability of the rail to buckle upon end-on impact while limiting loss of the lateral integrity of the structure. The terminal also assists in bringing vehicles to a controlled stop and in redirection of laterally impacting vehicles back toward the roadway. In a general aspect, the rail comprises a longitudinally corrugated and slotted rail which includes a slot guard spanning the downstream end of the slotted portion. The slot guard is preferably made of sufficient gauge steel or other suitable material to resist extension of the slots and parting of the rail upon being impacted.

The guardrail of the present invention is preferably employed as an end treatment for a conventional guardrail and provides a means of attenuating or of gating end-on impacts, as well as providing anchorage for oblique impacts from the side of the guardrail. The terminal can also be used with complimentary safety arrangements, such as the breakaway cable treatment used with the guardrail extruder terminal.

For clarity of illustration, the drawings and following discussion refer primarily to a slotted rail terminal generally adapted for use along roadways with expected vehicle speeds of about 45 mph. However, the present invention can be adapted for use along roadways having higher or lower vehicular speeds by varying the number, location and length of slots in the W-beam.

Figure 1:
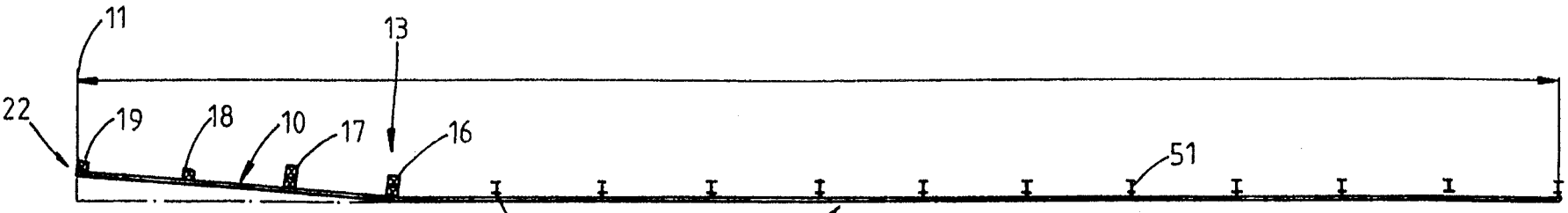
FIG. 1 is a plan view of an exemplary slotted rail terminal constructed in accordance with the present invention.
Figure 2:
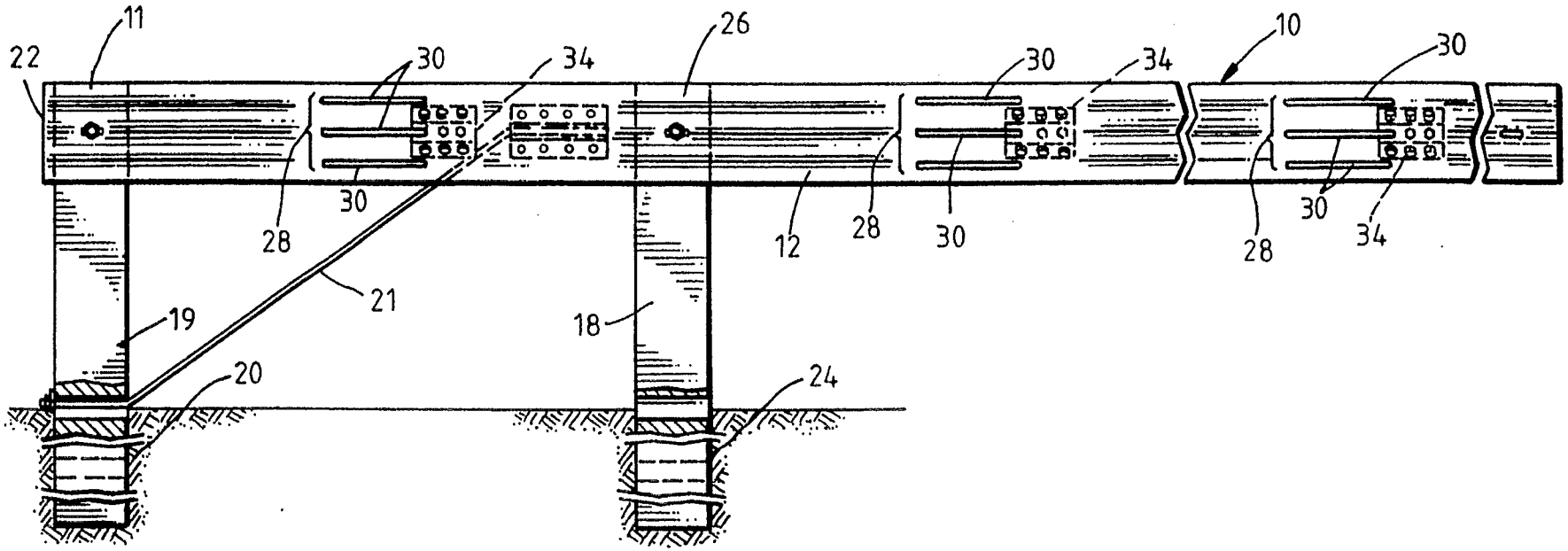
FIG. 2 is a side view of the upstream portion of the slotted rail terminal of FIG. 1.

Now referring to FIGS. 1 and 2, the guardrail terminal 10 includes a section of corrugated guardrail 12 mounted on one or more support posts 16, 17, 18 and 19. As shown, terminal 10 is employed in a preferred embodiment as an end terminal for a conventional guardrail assembly 50, which in turn is supported by support posts or stakes 51. As shown in FIG. 2, the W-beam guardrail 12 of the present invention preferably includes a series of multiple slotted zones 28 longitudinally spaced along the rail. It is preferred that each slotted zone 28 be approximately centered or placed at quarter-distance points between the support posts. The slotted zone 28 comprises one or more slots 30 longitudinally disposed in the W-beam guardrail 12. The use of three slots has proven effective in testing models of guardrails constructed similar to terminal 10.

A preferred placement of slots 30 within slotted zone 28 is better understood with reference to the cross-section for a typical W-beam guardrail 12 as shown in FIG. 4. A valley 44 is positioned between upper and lower peaks 32 and is formed at the intersections of inclined web portions 48. Edge members 49 laterally outlie each peak 32. Highly preferred placement for slots 30 is proximate each peak 32 and the valley 44. The slots 30 should be of a size sufficient to reduce the ability of the rail to resist buckling in response to a longitudinal loading from one end of the rail. Effective sizes for slots have been found to be approximately ½" in width and a minimum of 12" in length.

The dynamic buckling strength of the guardrail terminal can be tuned to any desirable level by controlling the number and length of slots 30. Generally, larger and longer slots have reduced dynamic buckling strength to a greater degree as has a greater number of slots. The number and length of slots can be selected to sufficiently reduce the buckling strength of the rail to safely accommodate impacts by different sizes of vehicles.

The slotted guardrail terminal 10 preferably includes one or more support posts 16, 17, 18 and 19. The terminal 10 features an upstream portion 11 and a more downstream portion 13 with the upstream portion 11 disposed relative to the expected direction of traffic and longitudinally disposed loadings on the rail from end-on impacts. Downstream portion 13 is preferably adapted to be fixedly connected to the adjoining conventional guardrail assembly 50 by means of bolts, rivets, or other known connection means. The posts 18 and 19 are preferably breakaway posts made of a material which is substantially frangible upon impact by a vehicle. Posts 18 and 19 may comprise 6"×8" rectangular wooden posts embedded in concrete 24 in the soil or ground 20. In an alternative embodiment, the posts 18 and 19 may be placed into vertically positioned steel foundation tubes of a type generally known in the art. At a more downstream point, the slotted rail terminal may be supported by conventional support posts 16 and 17 of more substantial wood, metal or other material. The guardrail 12 may be affixed to the posts 16, 17, 18 and 19 by fasteners 26 such as bolts. As shown in FIG. 3, boreholes 52 are provided in posts 16, 17, 18 and 19 near or below ground level. The posts are typically placed such that the center of the upper borehole 52 is flush with the ground surface 20.

A slot guard 34, as shown in FIGS. 6–8, is adapted to be attached to the W-beam guardrail 12 proximate the downstream end of each slotted zone 28 by the use of fasteners 56. The slot guard 34 preferably includes a number of holes 54 to facilitate connection of the slot guard 34 to the W-beam guardrail 12. As indicated particularly in FIGS. 2 and 4, the slot guard 34 is adapted to be attached to the rail 12 on the side facing away from the roadway. As FIG. 5 illustrates, the fasteners 56 typically comprise standard bolts, washers and nuts. The slot guard 34 should be constructed of thick gauge metal or a similar suitable substance. The slot guard 34 comprises a central portion 36 and two opposed wing portions 38. The central portion 36 further comprises an optional deflector 40 proximate the upstream end of the central portion 36 and extending at an angle away from the central portion 36. The configuration of deflector 40 resists over-expansion of the slotted section of the rail 12 which could result in the impacting vehicle piercing the rail. Wing portions 38 extend at an angle $\alpha$ from the perpendicular with central portion 36 so that the configuration of the central portion 36 and wing portions 38 permits the slot guard 34 to abut and be coupled to the W-beam guardrail 12 at the downstream end of each slotted zone 28. The central portion 36 abuts the valley 44 portion of the rail, and opposed wing portions 38 abut the web portions 48 of the rail on opposing sides of the valley 44. The slot guard 34 spans portions of slotted zone 28 to resist enlargement of at least one slot 30. Slot guard 34 is positioned such that angle 42 of the deflector 40 overlaps a downstream portion of the slot 30 in the peak 32 of the guardrail 12. With this placement of slot guard 34, the configuration of the deflector 40 and opposing wing portions 38 act to resist the expansion of at least central slot 30 in the valley 44 beyond the point of slot guard 34's attachment. Testing suggests that, a result of this resistance, the slotted zone 28 will tend to assist redirection of a laterally impacting vehicle rather than permitting the vehicle to tear through the structure of the rail 12.

Suitable slot guards have been constructed having general dimensions of 8½" in length, a 2⅜" central portion width, 3" flange 38 width, and a deflector length of 2". The opposite flanges are flared outward at an angle $\alpha$ of 34.8°. The deflector is flared at an angle of 45°.

In operation, the rail terminal 10 is typically positioned along a highway to prevent laterally impacting vehicles from penetrating the guardrail and encroaching into the area shielded by the guardrail. It is intended that a vehicle will impact the guardrail terminal 10 downstream of its upstream portion 11 and on the side of the terminal 10 facing the roadway.

The terminal may be installed either parallel to the roadway or in an angular departure from the roadway to enhance the "gating" features of the terminal. In a preferred embodiment, the slotted rail terminal of the present invention is installed with its upstream portion 11 at a parabolic flare away from the roadway. The parabolic flare is accomplished by increasing the offset of each support post in a generally parabolic progression as the terminal 10 proceeds upstream. The upstream portion 11 may also be flared away from the roadway using other configurations such as a linear or straight flare wherein the angled-away portion of rail is relatively straight rather than curved. For example, in a linear or straight flare arrangement, the most downstream post 16 of the terminal 10 would typically not be offset from the tangent section of guardrail 50. The next most upstream post 17 may be (6) six inches offset from tangent away from the roadway. The next upstream post 18 would be (12) twelve inches offset from tangent away from the roadway. The most upstream post 19 would be (18) eighteen inches offset from tangent away from the roadway. Positioning of the upstream end of the terminal in an angular departure away from the roadway permits the end to be readily buckled and bent away from the roadway during an end-on impact. This "gating" of the end facilitates movement of the impacting vehicle to the side of the rail opposite the roadway as the vehicle progresses.

Preferably, breakaway cable arrangement 21 is added to improve the tensile strength and anchorage capacity of terminal 10. Suitable breakaway cable arrangements are well known in the art. One suitable breakaway cable assembly is as Part No. F-37-76 in "a guide to standardized highway barrier rail hardware," ARTBA Bulletin No. 268-B, American Road and Transportation Assoc., Washington, D.C. 1979.

In testing, a guardrail terminal constructed in accordance with the present invention has proven effective in redirecting laterally impacting vehicles and in safely dissipating the impact energy of vehicles during impact. It has also demonstrated success in permitting controlled gating of vehicles during end-on impacts. Compliance crash tests were conducted to evaluate the performance of the slotted rail end terminal design in accordance to the guidelines presented in National Cooperative Highway Research Program Report (NCHRP) 230:

1. The first compliance crash test involved a 4,500-lb (2,041-kg) passenger car laterally impacting the test installation near the third most upstream post, located 12.5 ft (3.81 m) from the upstream end of the terminal, at a nominal speed of 45 mi/h (72.4 km/h) and angle of 25 degrees. The terminal's anchorage and lateral integrity were evaluated as well as the effectiveness of the design in redirecting a laterally impacting vehicle.
2. The second compliance crash test involved an end-on impact by an 1,800 lb (817-kg) passenger car at a nominal speed of 45 mi/h (72.4 km/h). The center of the vehicle was offset 15 in. (38.1 cm) from the center of the end terminal. The terminal was evaluated for vehicle stability and occupant risk.

Each test successfully met the evaluation criteria set forth in NCHRP Report 230. In the first test, the slotted rail terminal maintained its integrity and successfully redirected the impacting vehicle back toward the roadway. The test vehicle remained upright and stable during the impact period and after leaving the terminal. There was no debris from the vehicle or terminal that would present undue hazards to other traffic. There was moderate damage to both the guardrail and the impacting vehicle.

In the second test, the terminal successfully brought the end-on impacting vehicle to a safe and controlled stop. The test vehicle remained upright and stable during the entire impact sequence. There was no debris from the vehicle or terminal that could present an undue hazard to other traffic. Damage to the terminal was moderate. The damage to the impacting vehicle was severe and there was minor deformation in the floorplan area of the occupant compartment. However, the damage to the occupant compartment was judged to be minor.

While the invention is susceptible to various modifications and alternative forms, specific embodiments have been shown by way of example in the drawings and have been described in detail. However, it should be understood that the invention is not intended to be limited to the particular forms disclosed. For example, rather than a W-beam, the rail used with the terminal may have a different cross-sectional configuration. Other modifications and alterations will be apparent to those skilled in the art. The invention is intended to cover all modifications, equivalents and alternatives following within the spirit and scope of the invention as defined by the appended claims.

What is claimed is:

1. A highway guardrail terminal for extending along a roadway and having an upstream portion and a downstream portion, said terminal comprising:

(a) a longitudinally corrugated rail having upper and lower peaks and a valley between the peaks;

(b) at least one slotted section extending along the rail and comprising at least one longitudinally disposed slot in the rail of a size sufficient to reduce the ability of the rail to resist buckling in response to a longitudinal loading from one end of the rail; and (c) a slot guard attached to the rail proximate the downstream portion of said at least one slotted section relative to longitudinally disposed loadings on the rail, wherein said slot guard extends along the rail toward said upstream portion and comprises a deflector portion which diverges at an angle away from said rail.

2. The guardrail terminal of claim 1, wherein the slot guard comprises a central portion abutting the valley of the rail, and opposed wing portions abutting opposing sides of the valley.

3. The guardrail terminal of claim 2, wherein said deflector portion is proximate an end of the central portion and extends at said angle away from the central portion.

4. The guardrail terminal of claim 1, wherein said slot guard has an upstream end which overlaps a downstream portion of said at least one slotted section.

5. The guardrail terminal of claim 1, wherein the rail is substantially parallel to the roadway.

6. The guardrail terminal of claim 1, wherein the rail is flared at its upstream end away from the roadway.

7. The guardrail terminal of claim 6, wherein the flare is substantially parabolic.

8. The guardrail terminal of claim 6, wherein the flare is substantially straight.

9. The guardrail terminal of claim 1, wherein said at least one slotted section comprises three longitudinal slots cut into the rail, one of said slots being located proximate the valley of the rail, and one of said slots being located proximate each peak of the rail.

10. The guardrail terminal of claim 9 wherein said at least one slotted section comprises multiple slotted zones longitudinally spaced along the rail.

11. The guardrail terminal of claim 9, wherein said slots are about ½" wide and at least 12" in length.

12. The guardrail terminal of claim 1 wherein the downstream portion is adapted to be fixedly connected to an adjoining guardrail.

13. The guardrail terminal of claim 1 further comprising one or more support posts supporting the rail.

14. The guardrail terminal of claim 13 wherein at least one of the posts is a frangible post.

15. A highway guardrail terminal adapted to be placed alongside a roadway having an upstream portion and a downstream portion, said terminal comprising:

(a) a corrugated guardrail having upper and lower peaks and a valley between the peaks, said guardrail also having an upstream portion and a downstream portion and being supported by at least one frangible support post so that the downstream portion is adapted to be fixedly connected to an adjoining guardrail, said guardrail further being installed on a flare wherein the offset of each support post away from the roadway is increased as the rail process upstream;

(b) at least one slotted section between each support post, said slotted section comprising three longitudinally disposed slots in the guardrail, one said slot being located in the valley of the guardrail, and one of each said slots being located in either peak of the guardrail; and (c) a slot guard attached to the guardrail on the side facing away from the roadway and proximate said slotted section, said slot guard comprising a central portion abutting the valley of the rail, opposed wing portions abutting opposing sides of the valley, and a deflector attached to the central portion and extending at an angle away from the central portion.

16. A highway guardrail terminal for extending along a roadway and having an upstream portion and a downstream portion, said terminal comprising:

(a) a longitudinally corrugated rail having upper and lower peaks and a valley between the peaks;

(b) at least one slotted section extending along the rail and comprising at least one longitudinally disposed slot in the rail of a size sufficient to reduce the ability of the rail to resist buckling in response to a longitudinal loading from one end of the rail; and (c) a slot guard attached to the rail proximate the downstream portion of said at least one slotted section relative to longitudinally disposed loadings on the rail, said slot guard comprising a central portion abutting the valley of the rail and opposed wing portions abutting opposing sides of said valley, said slot guard further comprising a deflector proximate an end of said central portion and extending at an angle away from said central portion.

17. The guardrail terminal of claim 16 wherein said slot guard has an upstream end which overlaps a downstream portion of said at least one slotted section.

18. The guardrail terminal of claim 16 wherein the rail is flared at its upstream end away from the roadway.

19. The guardrail terminal of claim 16 wherein the slotted section comprises three longitudinal slots cut into the rail, one of said slots being located proximate the valley of the rail, and one of said slots being located proximate each peak of the rail.

* * * * *